US006820826B2

(12) United States Patent
Peterson, Jr.

(10) Patent No.: US 6,820,826 B2
(45) Date of Patent: Nov. 23, 2004

(54) SPRAY TARGETING TO AN ARCUATE SECTOR WITH NON-ANGLED ORIFICES IN FUEL INJECTION METERING DISC AND METHOD

(75) Inventor: William A. Peterson, Jr., Smithfield, VA (US)

(73) Assignee: Siemens VDO Automotive Corp., Auburn Hills, MI (US)

( * ) Notice: Subject to any disclaimer, the term of this patent is extended or adjusted under 35 U.S.C. 154(b) by 176 days.

(21) Appl. No.: 10/253,467

(22) Filed: Sep. 25, 2002

(65) Prior Publication Data

US 2004/0056113 A1 Mar. 25, 2004

(51) Int. Cl.[7] ..... F02M 59/00; F02M 39/00; F02M 61/00; B05B 1/30

(52) U.S. Cl. ..... 239/533.2; 239/533.3; 239/533.12; 239/533.14; 239/585.5; 239/585.1

(58) Field of Search ..... 239/533.2, 533.3, 239/533.12, 533.14, 585.1–585.5, 596, 88–92; 251/129.15, 129.21; 29/890.124, 890.127

(56) References Cited

U.S. PATENT DOCUMENTS

| | | | | |
|---|---|---|---|---|
| 4,057,190 A | | 11/1977 | Kiwior et al. | 239/558 |
| 4,101,074 A | | 7/1978 | Kiwior | 239/585 |
| 4,532,906 A | | 8/1985 | Hoppel | 123/470 |
| 4,925,111 A | | 5/1990 | Foertsch et al. | 239/533.12 |
| 5,038,738 A | | 8/1991 | Hafner et al. | 123/470 |
| 5,244,154 A | | 9/1993 | Buchholz et al. | 239/590.3 |
| 5,449,114 A | | 9/1995 | Wells et al. | 239/5 |
| 5,516,047 A | | 5/1996 | Kubach et al. | 239/585.5 |
| 5,730,368 A | | 3/1998 | Flik et al. | 239/575 |
| 5,766,441 A | | 6/1998 | Arndt et al. | 239/596 |
| 5,772,124 A | | 6/1998 | Tamaki et al. | 239/533.12 |
| 5,785,254 A | | 7/1998 | Zimmermann et al. | 239/490 |
| 5,862,991 A | | 1/1999 | Willke et al. | 239/397.5 |
| 5,931,391 A | | 8/1999 | Tani et al. | 239/533.12 |
| 5,976,342 A | * | 11/1999 | Arndt et al. | 205/170 |
| 6,050,507 A | * | 4/2000 | Holzgrefe et al. | 239/585.1 |
| 6,102,299 A | | 8/2000 | Pace et al. | 239/533.12 |
| 6,170,763 B1 | | 1/2001 | Fuchs et al. | 239/533.12 |
| 6,357,677 B1 | * | 3/2002 | Ren et al. | 239/585.4 |
| 6,394,367 B2 | | 5/2002 | Munezane et al. | 239/533.12 |
| 6,405,946 B1 | | 6/2002 | Harata et al. | 239/533.12 |
| 2002/0063175 A1 | | 5/2002 | Kitamura et al. | 239/585.1 |

FOREIGN PATENT DOCUMENTS

| | | |
|---|---|---|
| EP | 1 092 865 A | 4/2001 |
| EP | 1 154 151 | 11/2001 |
| JP | 10-122096 | 12/1998 |
| JP | 2000-097129 | 9/2000 |
| WO | WO 00/52328 | 9/2000 |

OTHER PUBLICATIONS

European Search Report, EP 01 20 1450, Aug. 1, 2001.
PCT/US02/17941 International Search Report, Sep. 25, 2002.
U.S. patent application Ser. No. 09/568,464, Injection Valve with Single Disc Turbulence Generation, filed May 10, 2000, C.Kim, pending.*

(List continued on next page.)

*Primary Examiner*—Davis Hwu

(57) ABSTRACT

A subassembly of a fuel injector that allows spray targeting and distribution of fuel to be configured using non-angled or straight orifice having an axis parallel to a longitudinal axis of the subassembly. Metering orifices are located about the longitudinal axis and defining a first virtual circle greater than a second virtual circle defined by a projection of the sealing surface onto the metering disc so that all of the metering orifices are disposed outside the second virtual circle within one quadrant of the circle. A channel is formed between the seat orifice and the metering disc that allows the fuel injector to target fuel spray generally within an arcuate sector of at least 90 degrees about the longitudinal axis of the metering disc. A method of targeting is also provided.

26 Claims, 7 Drawing Sheets

OTHER PUBLICATIONS

U.S. Divisional patent application Ser. No. 10/097,627, Injection Valve with Single Disc Turbulence Generation, filed Mar. 15, 2002, C. Kim, pending.*

U.S. patent application Ser. No. 10/162,759, Spray Pattern Control with Non–Angled Orifices in Fuel Injection Metering Disc, filed Jun. 6, 2002, Unassigned, pending.*

U.S. patent application Ser. No. 10/183,392, Spray Control with Non–Angled Orifices in Fuel Injection Metering Disc Methods, filed Jun. 28, 2002, Unassinged, pending.

U.S. patent application Ser. No. 10/183,406, Spray Pattern and Spray Distribution Control with Non–Angled Orifices in Fuel Injection Metering Disc and Method, filed Jun. 28, 2002, Unassigned, pending.

U.S. patent application Ser. No. 10/253,499, Generally Circular Spray Pattern Control with Non–Angled Orifices in Fuel Injection Metering Disc and Method, filed Sep. 25, 2002, Unassigned, pending.

U.S. patent application Ser. No. 10/253,468, Spray Pattern Control with Angular Orientation in Fuel Injector and Method, filed Sep. 25, 2002, Unassigned, pending.

* cited by examiner

FIG. 4A
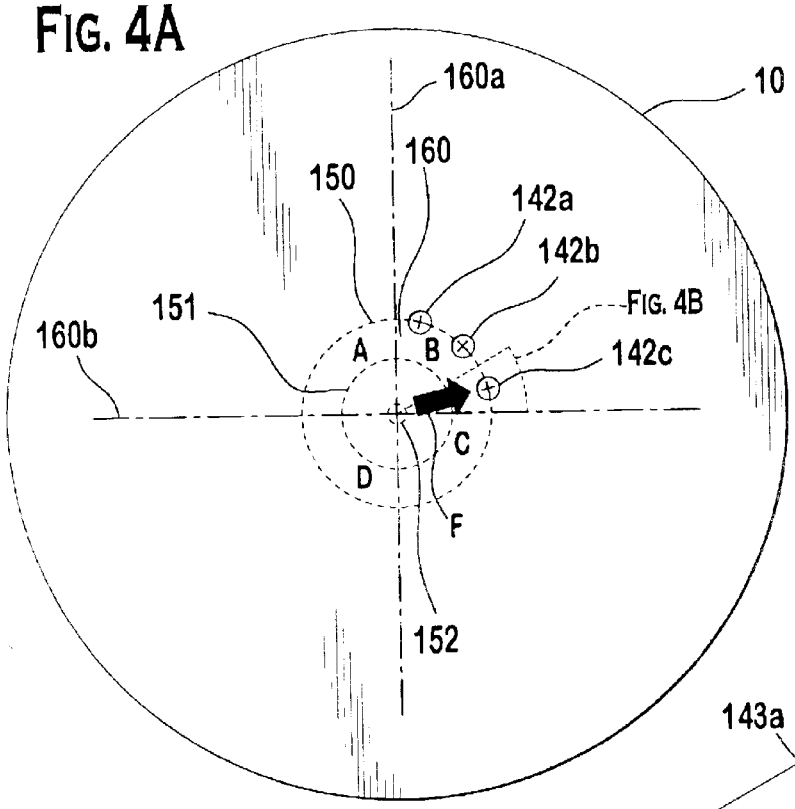
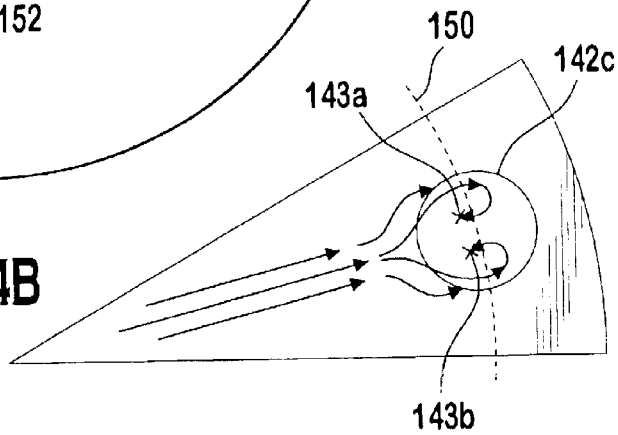
FIG. 4B
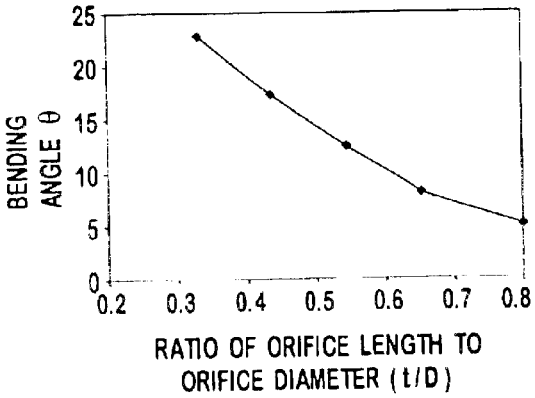
FIG. 5A
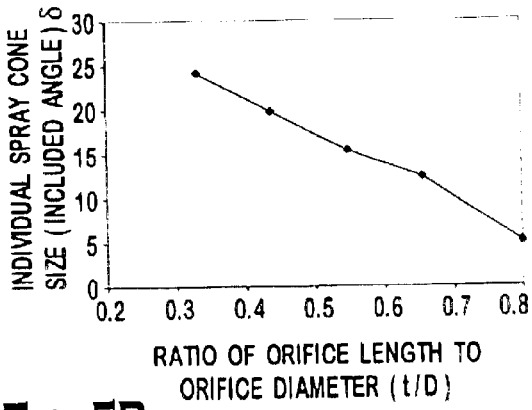
FIG. 5B

FIG. 6A
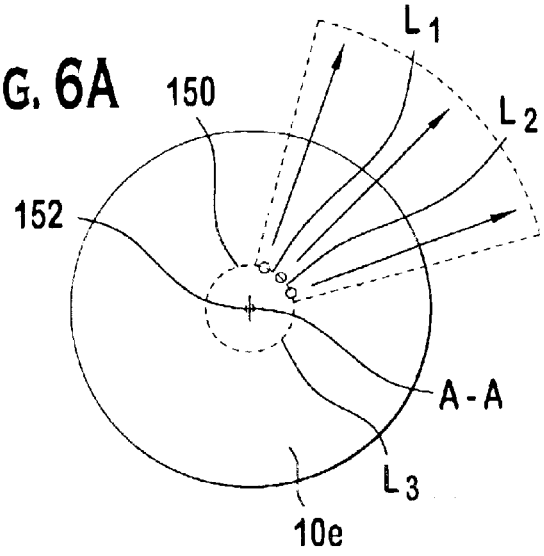
FIG. 6B
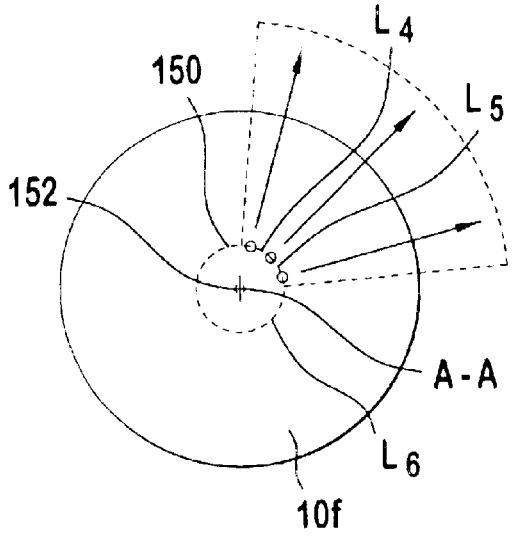
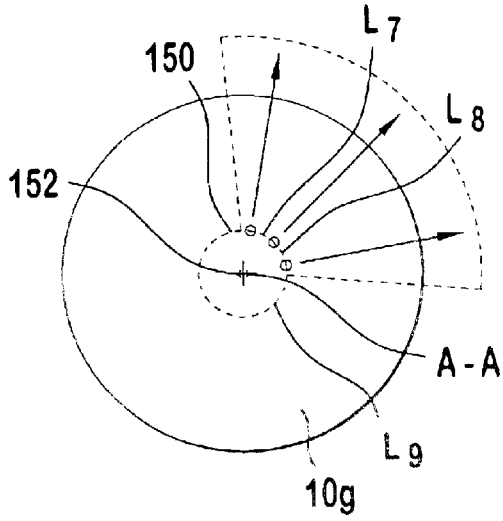
FIG. 6C

SPRAY TARGETING TO AN ARCUATE SECTOR WITH NON-ANGLED ORIFICES IN FUEL INJECTION METERING DISC AND METHOD

BACKGROUND OF THE INVENTION

Most modern automotive fuel systems utilize fuel injectors to provide precise metering of fuel for introduction towards each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electromagnetic fuel injector typically utilizes a solenoid assembly to supply an actuating force to a fuel metering assembly. Typically, the fuel metering assembly is a plunger-style closure member which reciprocates between a closed position, where the closure member is seated in a seat to prevent fuel from escaping through a metering orifice into the combustion chamber, and an open position, where the closure member is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.,), emission standards have become stricter, leading to tighter metering, spray targeting and spray or cone pattern requirements of the fuel injector for each engine configuration.

It would be beneficial to develop a fuel injector in which increased atomization and precise targeting can be changed so as to meet a particular fuel targeting and cone pattern from one type of engine configuration to another type.

It would also be beneficial to develop a fuel injector in which non-angled metering orifices can be used in controlling atomization, spray targeting and spray distribution of fuel towards an arcuate sector about the longitudinal axis for a predetermined distance downstream from the fuel injector.

SUMMARY OF THE INVENTION

The present invention provides fuel targeting and fuel spray distribution with non-angled metering orifices. In particular, the preferred embodiments of the invention allow for targeting of fuel flow to an arcuate sector about the longitudinal axis. In a preferred embodiment, a fuel injector is provided. The fuel injector includes a housing, a seat, a closure member and a metering disc. The housing has passageway extending between an inlet and an outlet along a longitudinal axis. The seat has a sealing surface facing the inlet and forming a seat orifice with a terminal seat surface spaced from the sealing surface and facing the outlet, and a first channel surface generally oblique to the longitudinal axis and is disposed between the seat orifice and the terminal seat surface. The closure member is disposed in the passageway and contiguous to the sealing surface so as to generally preclude fuel flow through the seat orifice in one position. The closure member is coupled to a magnetic actuator that, when energized, positions the closure member away from the sealing surface of the seat so as to allow fuel flow through the passageway and past the closure member. The metering disc is contiguous to the seat and includes a second channel surface confronting the first channel surface so as to form a flow channel. The metering disc has at least one metering orifice located outside of the first virtual circle. Each metering orifice extends generally parallel to the longitudinal axis between the second channel surface and a outer surface spaced from the second channel surface. The at least one metering orifice is located on one quadrant defined by two perpendicular planes parallel to and intersecting the longitudinal axis of the metering disc so that when the closure member is in the actuated position, a flow of fuel through the at least one metering orifice is targeted within an arcuate sector of at least 90 degrees about the longitudinal axis.

In yet another aspect of the present invention, a method targeting fuel flow to a desired sector downstream of a fuel injector about a longitudinal axis is provided. The fuel injector includes a passageway extending between an inlet and outlet along a longitudinal axis, a seat and a metering disc. The seat has a sealing surface facing the inlet and forming a seat orifice. The seat has a terminal seat surface spaced from the sealing surface and facing the outlet, and a first channel surface generally oblique to the longitudinal axis and disposed between the seat orifice and the terminal seat surface. The closure member is disposed in the passageway and contiguous to the sealing surface so as to generally preclude fuel flow through the seat orifice in one position. The closure member is coupled to a magnetic actuator that, when energized, positions the closure member away from the sealing surface of the seat so as to allow fuel flow through the passageway and past the closure member. The metering disc has at least one metering orifice extending between second and outer surfaces along the longitudinal axis with the second surface facing the first channel surface. The method can be achieved, in part, by locating the metering orifices outside of the first virtual circle and on at least one quadrant defined by two perpendicular planes parallel to and intersecting a longitudinal axis of the metering disc, the metering orifices extending generally parallel to the longitudinal axis through the second and outer surfaces of the metering disc; and targeting a flow of fuel through the at least one metering orifices within an arcuate sector of at least 90 degrees about the longitudinal axis upon actuation of the fuel injector.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

FIG. 4 illustrates a preferred embodiment of the metering disc arranged on a bolt circle.

FIGS. 5A and 5B illustrate a relationship between a ratio t/D of each metering orifice with respect to either bending angle or individual spray cone size for a specific configuration of the fuel injector.

FIGS. 6A, 6B, and 6C illustrate how a spray pattern can be adjusted by adjusting an arcuate distance between the metering orifices on a bolt circle.

FIGS. 7, 7A, 7B, 7C and 7D illustrate the orientation of a "bent" fuel spray.

DETAILED DESCRIPTION OF THE PREFERRED EMBODIMENTS

Figure 1:
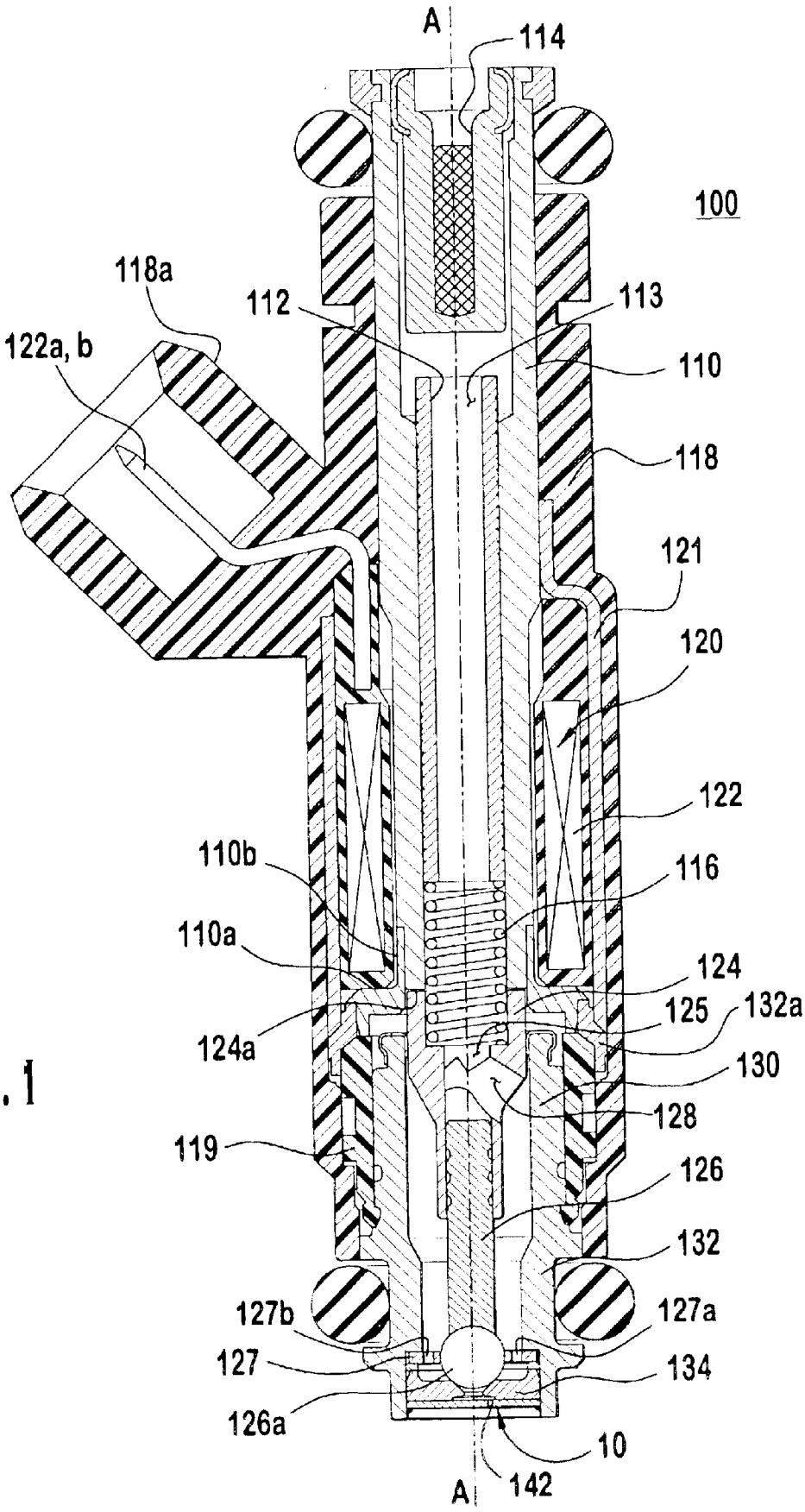
FIG. 1 illustrates a preferred embodiment of the fuel injector.

FIGS. 1–7 illustrate the preferred embodiments. In particular, a fuel injector 100 having a preferred embodiment of the metering disc 10 is illustrated in FIG. 1. The fuel injector 100 includes: a fuel inlet tube 110, an adjustment tube 112, a filter assembly 114, a coil assembly 118, a coil spring 116, an armature 124, a closure member 126, a non-magnetic shell 110*a*, a first overmold 118, a body 132, a body shell 132*a*, a second overmold 119, a coil assembly housing 121, a guide member 127 for the closure member 126, a seat 134, and a metering disc 10.

The guide member 127, the seat 134, and the metering disc 10 form a stack that is coupled at the outlet end of fuel injector 100 by a suitable coupling technique, such as, for example, crimping, welding, bonding or riveting. Armature 124 and the closure member 126 are joined together to form an armature/closure member assembly. It should be noted that one skilled in the art could form the assembly from a single component. Coil assembly 120 includes a plastic bobbin on which an electromagnetic coil 122 is wound.

Respective terminations of coil 122 connect to respective terminals 122*a*, 122*b* that are shaped and, in cooperation with a surround 118*a* formed as an integral part of overmold 118, to form an electrical connector for connecting the fuel injector to an electronic control circuit (not shown) that operates the fuel injector.

Fuel inlet tube 110 can be ferromagnetic and includes a fuel inlet opening at the exposed upper end. Filter assembly 114 can be fitted proximate to the open upper end of adjustment tube 112 to filter any particulate material larger than a certain size from fuel entering through inlet opening before the fuel enters adjustment tube 112.

In the calibrated fuel injector, adjustment tube 112 has been positioned axially to an axial location within fuel inlet tube 110 that compresses preload spring 116 to a desired bias force that urges the armature/closure member such that the rounded tip end of closure member 126 can be seated on seat 134 to close the central hole through the seat. Preferably, tubes 110 and 112 are crimped together to maintain their relative axial positioning after adjustment calibration has been performed.

After passing through adjustment tube 112, fuel enters a volume that is cooperatively defined by confronting ends of inlet tube 110 and armature 124 and that contains preload spring 116. Armature 124 includes a passageway 128 that communicates volume 125 with a passageway 113 in body 130, and guide member 127 contains fuel passage holes 127*a*, 127*b*. This allows fuel to flow from volume 125 through passageways 113, 128 to seat 134.

Non-ferromagnetic shell 110*a* can be telescopically fitted on and joined to the lower end of inlet tube 110, as by a hermetic laser weld. Shell 10*a* has a tubular neck that telescopes over a tubular neck at the lower end of fuel inlet tube 110. Shell 110*a* also has a shoulder that extends radially outwardly from neck. Body shell 132*a* can be ferromagnetic and can be joined in fluid-tight manner to non-ferromagnetic shell 110*a*, preferably also by a hermetic laser weld.

The upper end of body 130 fits closely inside the lower end of body shell 132*a* and these two parts are joined together in fluid-tight manner, preferably by laser welding. Armature 124 can be guided by the inside wall of body 130 for axial reciprocation. Further axial guidance of the armature/closure member assembly can be provided by a central guide hole in member 127 through which closure member 126 passes.

Prior to a discussion of the description of components of a fuel metering components proximate the outlet end of the fuel injector 100, it should be noted that the preferred embodiments of a seat and metering disc of the fuel injector 100 allow for a targeting of the fuel spray pattern (i.e., fuel spray separation) to be selected without relying on angled orifices. Moreover, the preferred embodiments allow the cone pattern (i.e., a narrow or large divergent cone spray pattern) to be selected based on the preferred spatial orientation of inner wall surfaces of the metering orifices being parallel to the longitudinal axis (i.e. so that the longitudinal axis of the wall surfaces is parallel to the longitudinal axis).

Figure 2A:
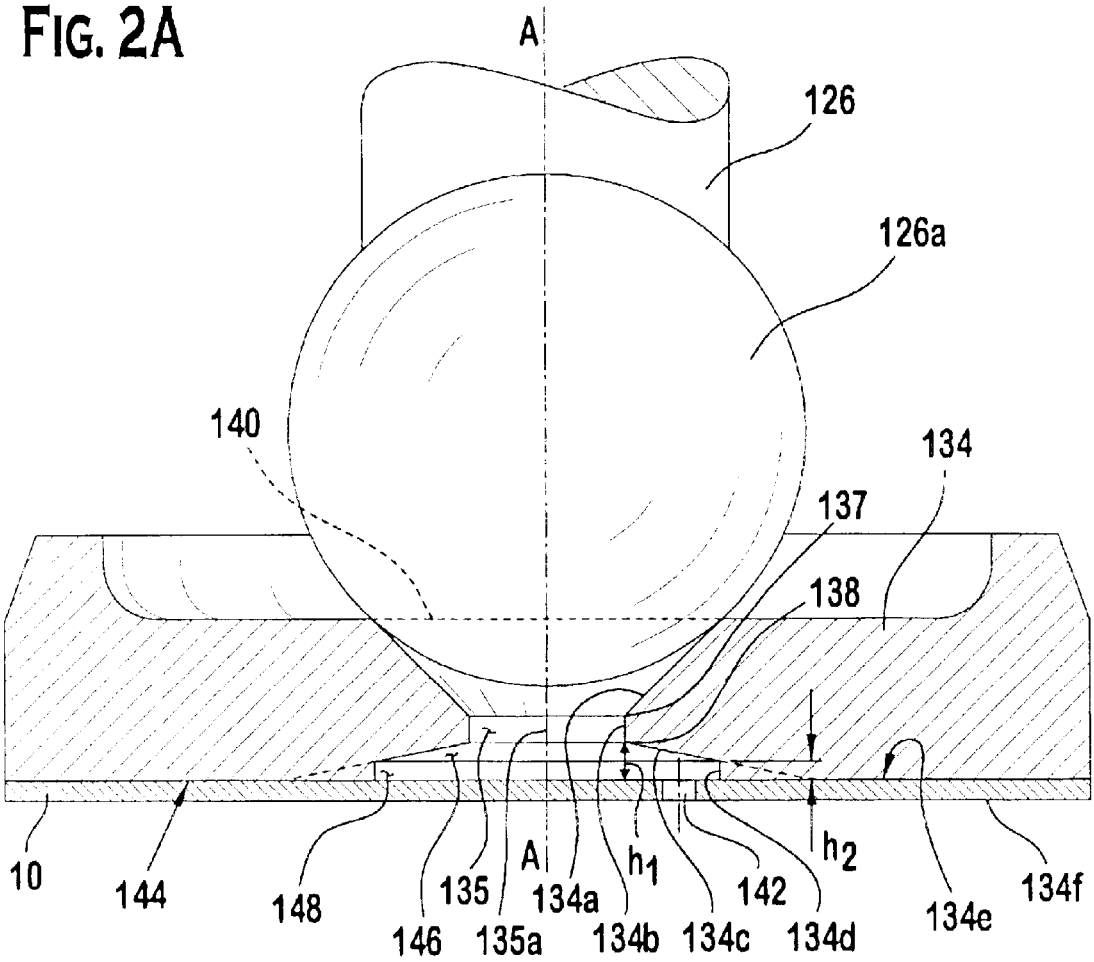
FIG. 2A illustrates a close-up cross-sectional view of an outlet end of the fuel injector of FIG. 1.

Referring to a close up illustration of the fuel metering components of the fuel injector in FIG. 2A which has a closure member 126, seat 134, and a metering disc 10. The closure member 126 includes a spherical surface shaped member 126*a* disposed at one end distal to the armature. The spherical member 126*a* engages the seat 134 on seat surface 134*a* so as to form a generally line contact seal between the two members. The seat surface 134*a* tapers radially downward and inward toward the seat orifice 135 such that the surface 134*a* is oblique to the longitudinal axis A—A. The seal can be defined as a sealing circle 140 formed by contiguous engagement of the spherical member 126*a* with the seat surface 134*a*, shown here in FIGS. 2A and 3. The seat 134 includes a seat orifice 135, which extends generally along the longitudinal axis A—A of the metering disc and is formed by a generally cylindrical wall 134*b*. Preferably, a center 135*a* of the seat orifice 135 is located generally on the longitudinal axis A—A. As used herein, the terms "upstream" and "downstream" denote that fuel flow generally in one direction from inlet through the outlet of the fuel injector while the terms "inward" and "outward" refer to directions toward and away from, respectively, the longitudinal axis A—A. And the longitudinal axis A—A is defined as the longitudinal axis of the metering disc, which in the preferred embodiments, is coincident with a longitudinal axis of the fuel injector.

Downstream of the circular wall 134*b*, the seat 134 tapers along a portion 134*c* towards a first metering disc surface 134*e*, which is spaced at a thickness "t" from a second metering disc surface or outer surface 134*f*. The taper of the portion 134*c* preferably can be linear or curvilinear with respect to the longitudinal axis A—A, such as, for example, a linear taper 134 (FIG. 2B) or a curvilinear taper 134*c*' that forms an compound curved dome (FIG. 2C).

In one preferred embodiment, the taper of the portion 134*c* is linearly tapered (FIG. 2B) in a downward and outward direction at a taper angle β away from the seat orifice 135 to a point radially past at least one metering orifice 142. At this point, the seat 134 extends along and is preferably parallel to the longitudinal axis so as to preferably form cylindrical wall surface 134*d*. The wall surface 134*d* extends downward and subsequently extends in a generally radial direction to form a bottom surface 134*e*, which is preferably perpendicular to the longitudinal axis A—A. Alternatively, the portion 134*c* can extend through to the surface 134*e* of the seat 134. Preferably, the taper angle β is about 10 degrees relative to a plane transverse to the longitudinal axis A—A. In another preferred embodiment, as shown in FIG. 2C, the taper is a second-order curvilinear taper 134*c*' which is suitable for applications that may require tighter control on the constant velocity of fuel flow. Generally, however, the linear taper 134*c* is believed to be suitable for its intended purpose in the preferred embodiments.

The interior face 144 of the metering disc 10 proximate to the outer perimeter of the metering disc 10 engages the bottom surface 134*e* along a generally annular contact area. The seat orifice 135 is preferably located wholly within the perimeter, i.e., a "bolt circle" 150 defined by an imaginary line connecting a center of each of at least one metering orifice 142. That is, a virtual extension of the surface of the seat 135 generates a virtual orifice circle 151 (FIG. 4A) preferably disposed within the bolt circle 150.

Figure 2B:
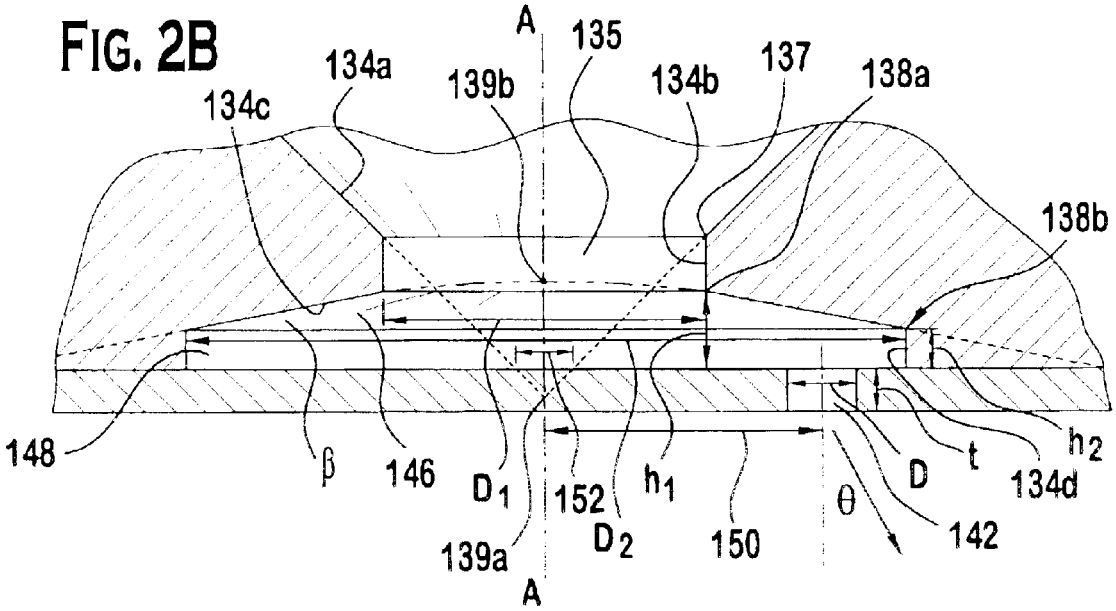
FIGS. 2B and 2C illustrate two close-up views of two preferred embodiments of the fuel metering components that, in particular, show the various relationships between various components in the fuel metering components.
Figure 2C:
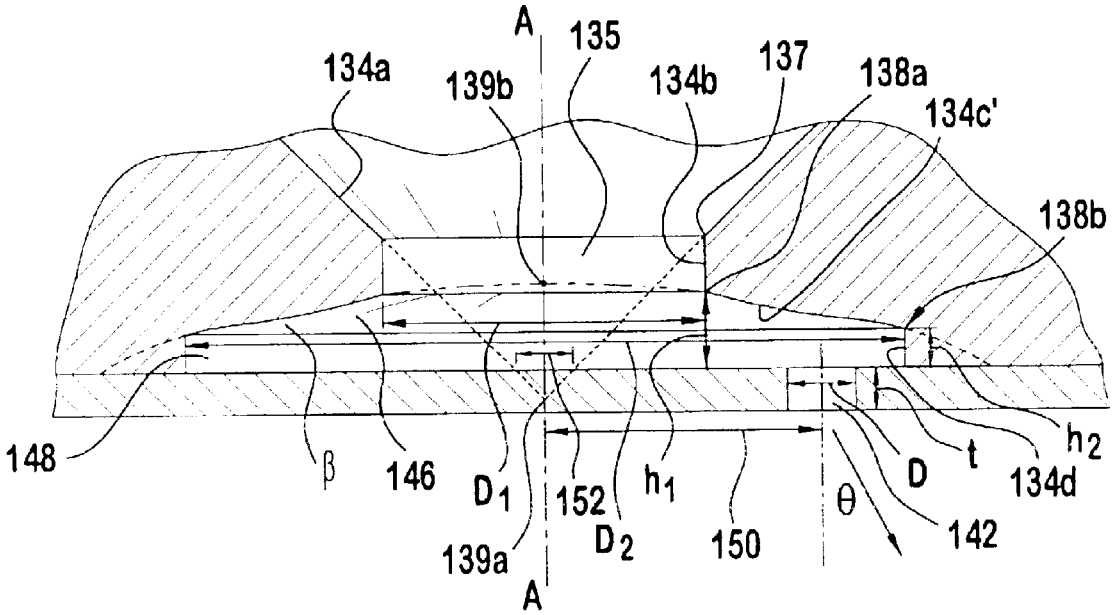
Figure 2D:
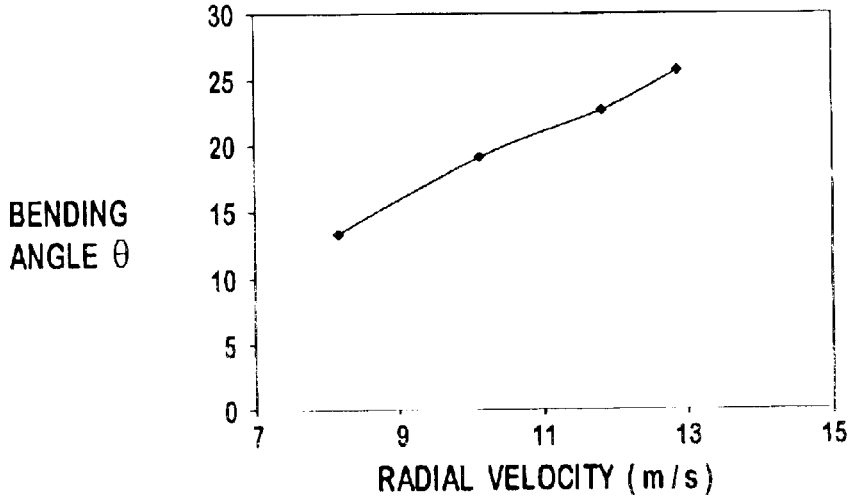
FIG. 2D illustrates a generally linear relationship between bending angle of fuel spray exiting the metering orifice to a radial velocity component of the fuel metering components

The cross-sectional virtual extensions of the taper of the seat surface 134*b* converge upon the metering disc so as to generate a virtual circle 152 (FIGS. 2B and 4). Furthermore, the virtual extensions converge to an apex 139*a* located within the cross-section of the metering disc 10. In one preferred embodiment, the virtual circle 152 of the seat surface 134*b* is located within the bolt circle 150 of the metering orifices. The bolt circle 150 is preferably entirely outside the virtual circle 152. It is preferable that all of the at least one metering orifice 142 are outside the virtual circle 152 such that an edge of each metering orifice can be on part of the boundary of the virtual circle but without being inside of the virtual circle. Preferably, the at least one metering orifice 142 includes three similarly configured metering orifices that are outside the virtual circle 152.

A generally annular controlled velocity channel 146 is formed between the seat orifice 135 of the seat 134 and interior face 144 of the metering disc 10, illustrated here in FIG. 2A. Specifically, the channel 146 is initially formed at an inner edge 138*a* between the preferably cylindrical surface 134*b* and the preferably linearly tapered surface 134*c*, which channel terminates at an outer edge 138*b* proximate the preferably cylindrical surface 134*d* and the terminal surface 134*e*. As viewed in FIGS. 2B and 2C, the channel changes in cross-sectional area as the channel extends outwardly from the inner edge 138*a* proximate the seat to the outer edge 138*b* outward of the at least one metering orifice 142 such that fuel flow is imparted with a radial velocity between the orifice and the at least one metering orifice.

Figure 3:
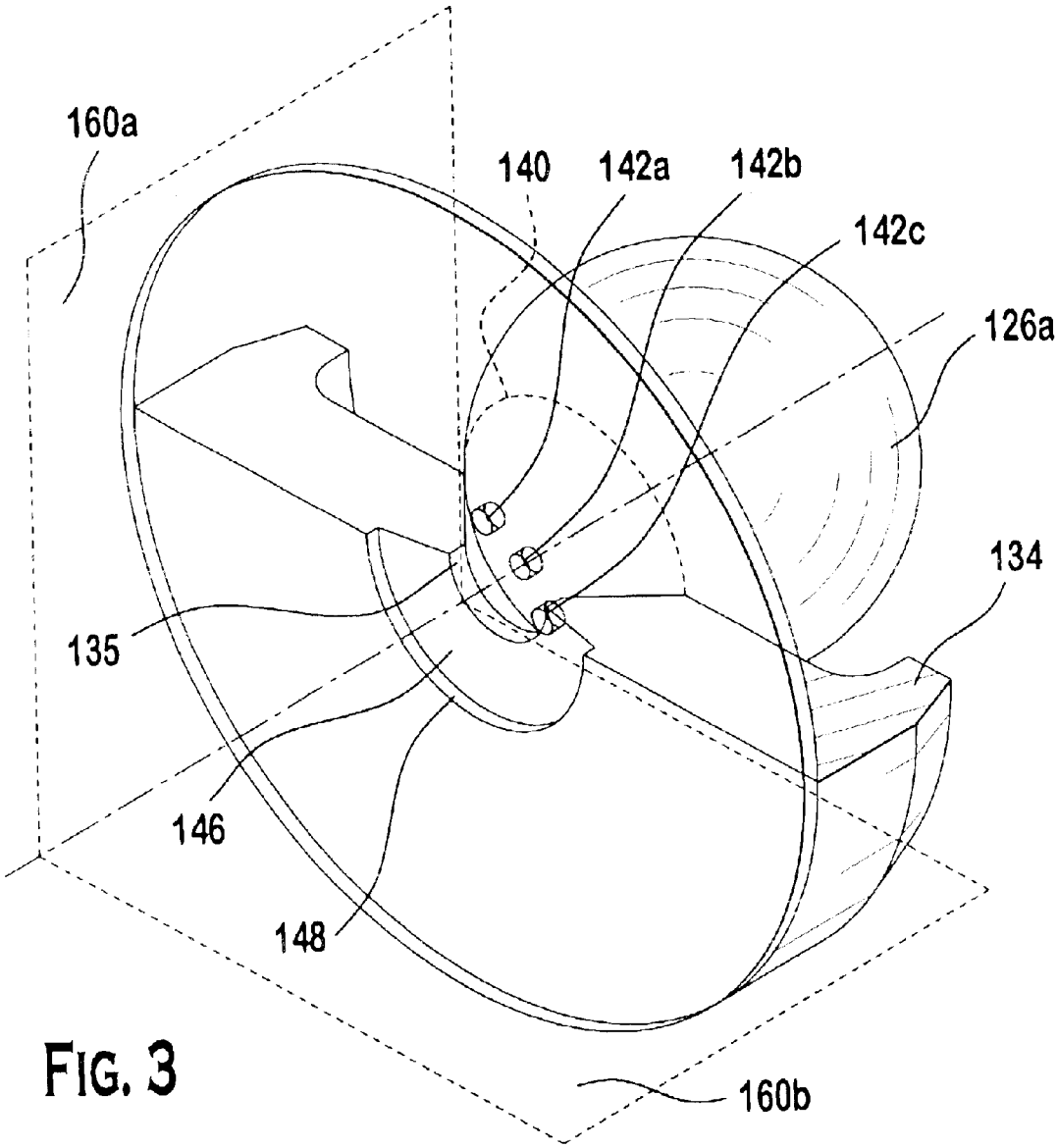
FIG. 3 illustrates a perspective view of outlet end of the fuel injector of FIG. 2A.

That is to say, a physical representation of a particular relationship has been discovered that allows the controlled velocity channel 146 to provide a constant velocity to fluid flowing through the channel 146. In this relationship, the channel 146 tapers outwardly from a first cylindrical area defined by the product of the pi-constant (π), a larger height $h_1$ proximate the seat orifice 135 with corresponding radial distance $D_1$ to a substantially equal cylindrical area defined by the pi-constant (π), a smaller height $h_2$ with correspondingly larger radial distance $D_2$ toward the at least one metering orifice 142. Preferably, a product of the height $h_1$, distance $D_1$ and π is approximately equal to the product of the height $h_2$, distance $D_2$ and π (i.e. $D_1*h_1*\pi=D_2*h_2*\pi$ or $D_1*h_1=D_2*h_2$) formed by a taper, which can be linear or curvilinear. The distance $h_2$ is believed to be related to the taper in that the greater the height $h_2$, the greater the taper angle β is required and the smaller the height $h_2$, the smaller the taper angle β is required. An annular space 148, preferably cylindrical in shape with a length $D_2$, is formed between the preferably linear wall surface 134*d* and an interior face of the metering disc 10. And as shown in FIGS. 2A and 3, a frustum is formed by the controlled velocity channel 146 downstream of the seat orifice 135, which frustum is contiguous to preferably a right-angled cylinder formed by the annular space 148.

In another preferred embodiment, the cylinder of the annular space 148 is not used and instead a frustum forming part of the controlled velocity channel 146 is formed. That is, the channel surface 134*c* extends all the way to the surface 134*e* contiguous to the metering disc 10, and referenced in FIGS. 2B and 2C as dashed lines. In this embodiment, the height $h_2$ can be referenced by extending the distance $D_2$ from the longitudinal axis A—A to a desired point transverse thereto and measuring the height $h_2$ between the metering disc 10 and the desired point of the distance $D_2$. It is believed that the channel surface in this embodiment has a tendency to increase a sac volume of the seat, which may be undesirable in various fuel injector applications. Preferably the desired distance $D_2$ can be defined by an intersection of a transverse plane intersecting the channel surface 134*c* or 134*c*' at a location at least 25 microns outward of the radially outermost perimeter of each metering orifice 142.

By providing a constant velocity of fuel flowing through the controlled velocity channel 146, it is believed that a sensitivity of the position of the at least one metering orifice 142 relative to the seat orifice 135 in spray targeting and spray distribution is minimized. That is to say, due to manufacturing tolerances, acceptable level concentricity of the array of metering orifices 142 relative to the seat orifice 135 may be difficult to achieve. As such, features of the preferred embodiment are believed to provide a metering disc for a fuel injector that is believed to be less sensitive to concentricity variations between the array of metering orifices 142 on the bolt circle 150 and the seat orifice 135. It is also noted that those skilled in the art will recognize that from the particular relationship, the velocity can decrease, increase or both increase/decrease at any point throughout the length of the channel 146, depending on the configuration of the channel, including varying $D_1$, $h_1$, $D_2$ or $h_2$ of the controlled velocity channel 146, such that the product of $D_1$ and $h_1$ can be less than or greater than the product of $D_2$ and $h_2$. Moreover, not only is the flow is at a generally constant velocity through a preferred configuration of the controlled velocity channel 146, it has been discovered that the flow through the metering orifices 142 tends to generate at least two vortices within the metering orifices. The at least two vortices generated in the metering orifice can be confirmed by modeling a preferred configuration of the fuel metering components by Computational-Fluid-Dynamics, which is believed to be representative of the true nature of fluid flow through the metering orifices. For example, as shown in FIG. 4B, flow lines flowing radially outward from the seat orifice 135 tend to generally curved inwardly proximate the orifice 142*a* so as to form at least two vortices 143*a* and 143*b* within a perimeter of the metering orifice 142*a*, which is believed to enhance spray atomization of the fuel flow exiting each of the metering orifices 142.

Furthermore, by imparting a different radial velocity to fuel flowing through the seat orifice 135, it has been discovered that a bending angle θ of fuel spray exiting the at least one metering orifice 142 can be changed as a generally linear function of the radial velocity component of the fuel flow. For example, in a preferred embodiment shown here in FIG. 2D, by changing a radial velocity component of the fuel flowing (between the orifice 135 and the at least one metering orifice 142 through the controlled velocity channel 146) from approximately 8, meter-per-second to approximately 13 meter-per-second, the bending angle changes correspondingly from approximately 13 degrees to approximately 26 degrees. The radial velocity component can be changed preferably by changing the configuration of the fuel metering components (including $D_1$, $h_1$, $D_2$ or $h_2$ of the controlled velocity channel 146), changing the flow rate of the fuel injector, or by a combination of both.

Furthermore, it has also been discovered that spray separation targeting can also be adjusted by varying a ratio of the through-length (or orifice length) "t" of each metering orifice to the largest distance "D" between two diametrically opposed inner surfaces of the metering orifice as referenced to the longitudinal axis. The ratio t/D can be varied from 0.3 to 1.0 or greater. In particular, the bending angle θ as referenced to a centroid 155*a* of a spray pattern relative to a longitudinal axis is linearly and inversely related, shown here in FIG. 5A for a preferred embodiment, to the aspect ratio t/D. Here, as the ratio changes from approximately 0.3 to approximately 0.8, the bending angle θ generally changes linearly and inversely from approximately 22 degrees to approximately 8 degrees. Hence, where a small spray pattern size is desired but with a large bending angle, it is believed that spray separation can be accomplished by configuring the velocity channel 146 and space 148 while spray pattern size can be accomplished by configuring one of the t/D ratio or arcuate distance between each metering orifice of the metering disc 10. It should be noted that the ratio t/D not only affects the bending angle, it also affects a size of the spray pattern emanating from the metering orifice in a linear and inverse manner, shown here in FIG. 5B. The size of a spray pattern, preferably conical in a side view, is defined as an included angle θ of distal flow paths on a perimeter of the spray pattern downstream of the fuel injector. In FIG. 5B, as the ratio changes from approximately 0.3 to approximately 0.8, the spray pattern size or "cone size," as measured as an included angle δ, changes generally linearly and inversely to the ratio t/D. And although the through-length "t" (i.e., the length of the metering orifice along the longitudinal axis A—A) is shown in FIG. 2B as being substantially the same as that of the thickness of the metering disc 10, it is noted that the thickness of the metering disc can be different from the through-length "t" of the metering orifice 142.

Figure 7C:
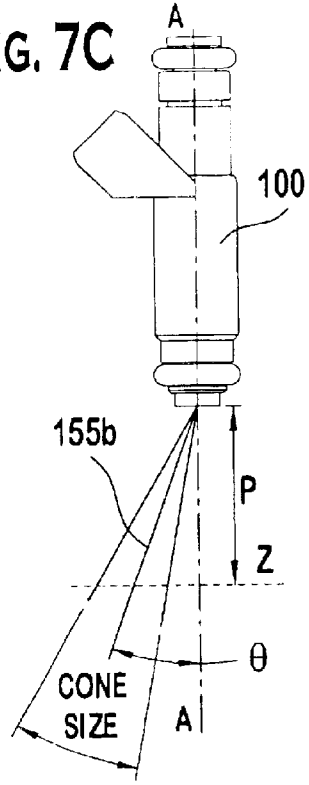
Figure 7D:
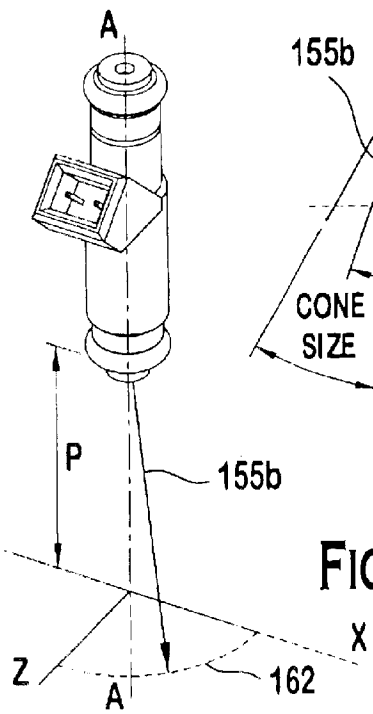

The metering or metering disc 10 has at least one metering orifice 142. Each metering orifice 142 has a center defined by inner wall surfaces, and each center is located on an imaginary "bolt circle" 150 shown here in FIG. 4. For clarity, each metering orifice is labeled as 142*a*, 142*b*, 142*c* . . . and so on in FIGS. 3 and 4A. Although each metering orifice 142 is preferably circular so that the distance D is generally the same as the diameter of the circular orifice (i.e., between diametrical inner surfaces of the circular opening), other orifice configurations, such as, for examples, square, rectangular, arcuate or slots can also be used. The bolt or second circle 150 is arrayed in a preferably circular configuration, which configuration, in one preferred embodiment, can be generally concentric with the virtual circle 152. A seat orifice virtual circle 151 (FIG. 4A) is formed by a virtual projection of the orifice 135 onto the metering disc such that the seat orifice virtual circle 151 is outside of the virtual circle 152 and preferably generally concentric to both the first and second virtual circle 150. Extending from the longitudinal axis A—A are two perpendicular planes 160*a* and 160*b* that along with the bolt circle 150 divide the bolt circle into four contiguous quadrants A, B, C and D. In a preferred embodiment, the metering orifices are disposed on the virtual circle 150 in one quadrant. The preferred configuration of the metering orifices 142 and the channel allows a flow path "F" of fuel extending radially from the orifice 135 of the seat in any one radial direction away from the longitudinal axis towards the metering disc passes to one metering orifice or orifice and to an arcuate sector of at least 90 degrees about the longitudinal axis. The flow path is bounded within the arcuate sector 162 at a distance P downstream of the metering disc 10 (FIGS. 7C and 7D). Preferably, the distance P is at least 50 millimeters and particularly about 100 millimeters downstream of the metering disc.

In addition to spray targeting with adjustment of the radial velocity and cone size determination by the controlled velocity channel and the aspect ratio t/D, respectively, a spatial orientation of the non-angled orifice openings 142 can also be used to shape the pattern of the fuel spray by changing the arcuate distance "L" between the metering orifices 142 along a bolt circle 150 in another preferred embodiment. FIGS. 6A–6C illustrate the effect of arraying the metering orifices 142 on progressively larger arcuate distances between the metering orifices 142 so as to achieve increases in the individual cone size 6 of each metering orifice 142 with corresponding decreases in the bending angle. This effect can be seen starting with metering disc 10*a* and moving through metering disc 10*c*.

In FIG. 6A, relatively close arcuate distances $L_1$ and $L_2$ (where $L_1=L_2$ and $L_3>L_2$ in a preferred embodiment) of the metering orifice relative to each other form a narrow cone pattern. In FIG. 6B, spacing the metering orifices 142 at a greater arcuate distance (where $L_4=L_5$ and $L_6>L_4$ in a preferred embodiment) than the arcuate distances in FIG. 6A form a relatively wider cone pattern at a relatively smaller bending angle. In FIG. 6C, an even wider cone pattern at an even smaller bending angle is formed by spacing the metering orifices 142 at even greater arcuate distances (where $L_7=L_8$ and $L_9>L_7$ in a preferred embodiment) between each metering orifice 142. It should be noted that in these examples, the arcuate distance $L_1$ can be greater than or less than $L_2$, $L_4$ can be greater or less than $L_5$ and $L_7$ can be greater than or less than $L_8$ and that a arcuate distance can be a linear distance between closest inner wall surfaces or edges of respective adjacent metering orifices on the bolt circle 151. Preferably, the linear distance is greater than or equal to the thickness "t" of the metering disc. The thickness "t" is at least 50 microns. In a preferred embodiment, the thickness "t" can be selected from a group comprising one of 50, 75, 100, 125, 150 and 200 microns.

The adjustment of arcuate distances can also be used in conjunction with the process previously described so as to tailor the spray geometry (narrower spray pattern with greater spray angle to wider spray pattern but at a smaller bending angle θ) of a fuel injector to a specific engine design while using non-angled metering orifices (i.e. openings having a generally straight bore generally parallel to the longitudinal axis A—A).

Figure 7A:
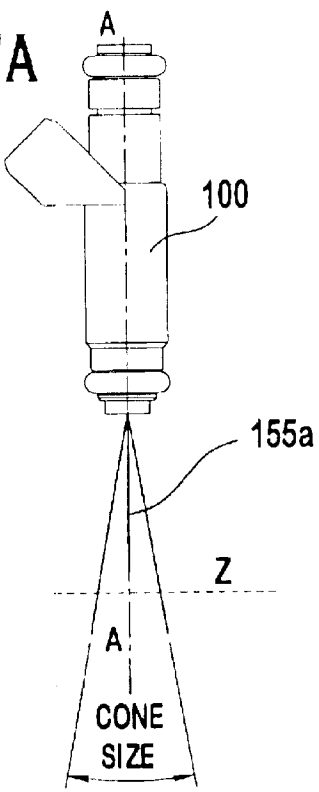
Figure 7B:
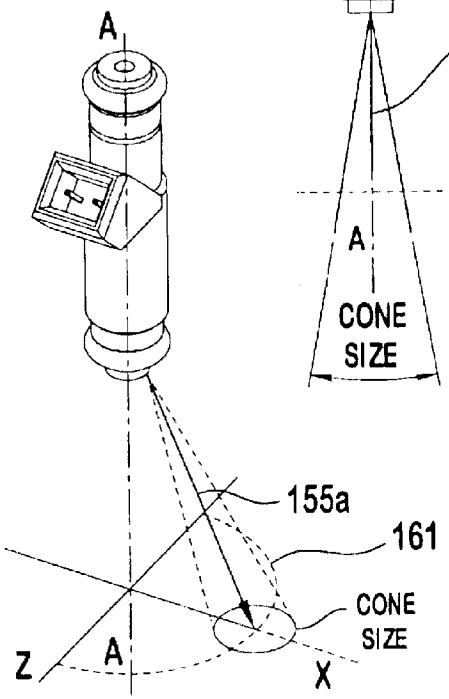
Figure 7:
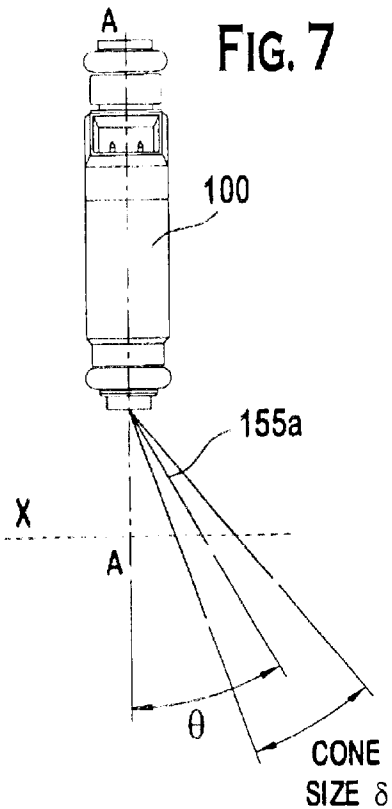

In FIG. 7, the fuel injector is shown injecting a stream of fuel spray pattern similar to that of FIG. 6A. In FIG. 7A, the fuel injector is rotated 90 degrees. That is, with a three-dimensional perspective view of FIG. 7B, in one configuration of the spray stream, the centroidal axis 155*a* is on a plane orthogonal to axis Z while being located on a plane defined by axes X and A—A so that the spray stream is bounded by an arcuate sector 161 of about 180 degrees. The spray stream pattern has an included angle δ as measured from a virtual centroidal axis 155*a* of the stream to the longitudinal axis, and can be configured as described above by varying the arcuate distances between the orifices and the ratio t/D. And preferably in another configuration, the spray stream 155*b* is bent at a bending angle θ relative to a plane formed by axis X and the longitudinal axis A—A. It should be noted that at least one stream, represented by a centroidal axis 155*b* in FIGS. 7C and 7D can be bent so that the stream is targeted in an arcuate sector 162 of at least 90 degrees about the longitudinal axis that extends approximately 100 millimeters downstream of the metering disc 10. The arcuate sector 162 is bounded by two planes 160*a* and 160*b* intersecting the longitudinal axis A—A and parallel thereto.

The bending angle θ and cone size δ of the fuel spray are related to the aspect ratio t/D. As the aspect ratio increases or decreases, the bending angle θ and cone size δ increase or decrease, at different rates, correspondingly. Where the distance D is held constant, the larger the thickness "t", the smaller the bending angle θ and cone size δ. Conversely, where the thickness "t" is smaller, the bending angle θ and cone size δ are larger. As noted earlier, the cone size δ can be adjusted larger or smaller by configuration of the flow channel so as to provide for an increase or a decrease in a radial velocity component of the fuel flowing through the channel, respectively.

In operation, the fuel injector 100 is initially at the non-injecting position shown in FIG. 1. In this position, a working gap exists between the annular end face 110*b* of fuel inlet tube 110 and the confronting annular end face 124*a* of armature 124. Coil housing 121 and tube 12 are in contact at 74 and constitute a stator structure that is associated with coil assembly 18. Non-ferromagnetic shell 110*a* assures that when electromagnetic coil 122 is energized, the magnetic flux will follow a path that includes armature 124. Starting at the lower axial end of housing 34, where it is joined with body shell 132*a* by a hermetic laser weld, the magnetic circuit extends through body shell 132*a*, body 130 and eyelet to armature 124, and from armature 124 across working gap 72 to inlet tube 110, and back to housing 121.

When electromagnetic coil 122 is energized, the spring force on armature 124 can be overcome and the armature is attracted toward inlet tube 110, reducing working gap 72. This unseats closure member 126 from seat 134 open the fuel injector so that pressurized fuel in the body 132 flows through the seat orifice and through orifices formed on the metering disc 10. It should be noted here that the actuator may be mounted such that a portion of the actuator can disposed in the fuel injector and a portion can be disposed outside the fuel injector. When the coil ceases to be energized, preload spring 116 pushes the closure member closed on seat 134.

As described, the preferred embodiments, including the techniques or method of targeting, are not limited to the fuel injector described but can be used in conjunction with other fuel injectors such as, for example, the fuel injector sets forth in U.S. Pat. No. 5,494,225 issued on Feb. 27, 1996, or the modular fuel injectors set forth in Published U.S. patent application Ser. No. 2002/0047054 A1, published on Apr. 25, 2002, which is pending, and wherein both of these documents are hereby incorporated by reference in their entireties.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fuel injector comprising:

a housing having a passageway extending between an inlet and an outlet along a longitudinal axis;

a seat having a sealing surface facing the inlet and forming a seat orifice, terminal seat surface spaced from the sealing surface and facing the outlet, a first channel surface generally oblique to the longitudinal axis and disposed between the seat orifice and the terminal seat surface; a closure member disposed in the passageway and contiguous to the sealing surface so as to generally preclude fuel flow through the seat orifice in one position, the closure member being coupled to a magnetic actuator that, when energized, positions the closure member away from the sealing surface of the seat so as to allow fuel flow through the passageway and past the closure member; and a metering disc proximate the seat so that a virtual projection of the sealing surface onto a metering disc defines a first virtual circle about the longitudinal axis, the metering disc including a second channel surface confronting the first channel surface so as to form a flow channel, the metering disc having at least one metering orifice located outside of the first virtual circle, each of the at least one metering orifice extending generally parallel to the longitudinal axis between the second channel surface and an outer surface of the metering disc, the at least one metering orifice being located on one quadrant defined by first and second perpendicular planes parallel to and intersecting the longitudinal axis so that when the coil energizes the closure member to the actuated position, a flow of fuel through the at least one metering orifice is targeted within an arcuate sector of at least 90 degrees about the longitudinal axis proximate the metering disc.

2. The fuel injector of claim 1, wherein the at least one metering orifice comprises three metering orifices disposed on a second virtual circle outside the first virtual circle and generally concentric to the first virtual circle.

3. The fuel injector of claim 1, wherein the at least one metering orifice comprises two metering orifices disposed at a first arcuate distance relative to each other on a second virtual circle outside the first virtual circle and generally concentric to the first virtual circle.

4. The fuel injector of claim 3, wherein the outer surface is spaced from the second channel surface of the metering disc at a first thickness of at least 50 microns, and a first arcuate spacing comprises a linear distance between closest edges of adjacent metering orifices at least equal to approximately the first thickness.

5. The fuel injector of claim 4, wherein the first thickness of the metering disc comprises a thickness selected from a group comprising one of approximately 75, 100, 150, and 200 microns.

6. The fuel injector of claim 5, wherein the aspect ratio is inversely and generally related in a linear manner to an included angle of the fuel flow through each metering orifice of between approximately fifteen degrees to approximately five degrees.

7. The fuel injector of claim 4, wherein the first thickness of the metering disc comprises a thickness of approximately 125 microns.

8. The fuel injector of claim 1, wherein the at least one metering orifice comprises at least three metering orifices spaced at different arcuate distances on a second virtual circle outside the first virtual circle and generally concentric to the first virtual circle.

9. The fuel injector of claim 1, wherein the at least one metering orifice comprises at least one metering orifice having an aspect ratio of between approximately 0.3 and 1.0, the aspect ratio being generally equal to approximately a length of the at least one metering orifice between the second channel and outer surfaces divided by approximately the largest distance perpendicular to the longitudinal axis between any two diametrical inner surfaces of the at least one metering orifice.

10. The fuel injector of claim 1, wherein first channel surface comprises an inner edge being located at approximately a first distance from the longitudinal axis and at approximately a first spacing along the longitudinal axis relative to the metering disc and an outer edge being located at approximately a second distance from the longitudinal axis and at approximately a second spacing from the metering disc along the longitudinal axis, such that a product of the first distance and first spacing is generally equal to a product of the second distance and second spacing.

11. The fuel injector of claim 10, wherein the second distance is located at an intersection of a plane transverse to the longitudinal axis and the channel surface such that the intersection is at least 25 microns radially outward of the perimeter of a metering orifice.

12. The fuel injector of claim 1, wherein the projection of the sealing surface further converging at a virtual apex disposed within the metering disc, and the channel comprises a second portion extending from the first portion, the second portion having a constant sectional area as the channel extends along the longitudinal axis.

13. The fuel injector of claim 1, wherein the arcuate sector extends at least 50 millimeters from an outer surface of the metering disc.

14. The fuel injector of claim 1, wherein the arcuate sector extends at approximately 180 degrees about the longitudinal axis.

15. A method of controlling a spray angle of fuel flow through at least one metering orifice of a fuel injector to an arcuate sector disposed about the longitudinal axis, the fuel injector having a passageway between an inlet and outlet along a longitudinal axis, a seat and a metering disc proximate the outlet, the seat having a sealing surface facing the inlet and forming a seat orifice, a terminal seat surface spaced from the sealing surface and facing the outlet, a first channel surface generally oblique to the longitudinal axis and disposed between the seat orifice and the terminal seat surface, a closure member disposed in the passageway and being coupled to a magnetic actuator that, when energized, positions the closure member so as to allow fuel flow through the passageway and past the closure member through the seat orifice, the metering disc having at least one metering orifice extending between second and outer surfaces being spaced apart along the longitudinal axis with the second surface facing the first channel surface so that a virtual projection of the sealing surface onto a metering disc defines a first virtual circle, the method comprising:

locating the metering orifices outside of the first virtual circle and on one quadrant defined by first and second perpendicular planes parallel to and intersecting a longitudinal axis of the metering disc, the metering orifices extending generally parallel to the longitudinal axis through the second and outer surfaces of the metering disc; and targeting a flow of fuel through the at least one metering orifices within an arcuate sector of at least 90 degrees about the longitudinal axis upon actuation of the fuel injector.

16. The method of claim 15, wherein the locating of the metering orifices comprises generating a generally conical spray size of the flow path as a function of one of a first arcuate spacing and an aspect ratio of the at least one metering orifice, the conical spray size of the flow path being defined by an included angle of the outer perimeter of the conical spray size downstream of the fuel injector, and the aspect ratio being generally equal to approximately a length of the at least one metering orifice between the second channel surface and the third channel surface divided by approximately the largest distance perpendicular to the longitudinal axis between any two diametrical inner surfaces of the at least one metering orifice.

17. The method of claim 15, wherein the generating comprises one of:

increasing a first arcuate spacing so as to increase the included angle of the flow path; and decreasing the first arcuate spacing so as to decrease the included angle of the flow path.

18. The method of claim 15, wherein the included angle comprises an angle between approximately 10 to 20 degrees, and a first arcuate spacing comprises a linear distance between closest edges of adjacent metering orifices at least equal to approximately the first thickness.

19. The method of claim 18, wherein the orientating comprises changing the bending angle by one of:

increasing the aspect ratio so as to decrease the bending angle; and decreasing the aspect ratio so as to increase the bending angle.

20. The method of claim 18, wherein the orientating comprises changing the included angle of the cone size by one of:

increasing a radial velocity of the fuel flowing through the channel so as to increase the included angle; and decreasing a radial velocity of the fuel flowing through the channel so as to decrease the included angle.

21. The method of claim 20, wherein the second distance is located at an intersection of a plane transverse to the longitudinal axis and the channel surface such that the intersection is at least 25 microns radially outward of the perimeter of a metering orifice.

22. The method of claim 15, wherein the targeting comprises orientating the flow path within the arcuate sector at a bending angle relative to a plane parallel and intersecting the longitudinal axis as a function of a first aspect ratio of each metering orifice, the aspect ratio being generally equal to approximately a length of the at least one metering orifice between the second channel and outer surfaces over approximately the largest distance perpendicular to the longitudinal axis between any two diametrical surfaces of the at least one metering orifice.

23. The method of claim 15, wherein the targeting comprises generating at least two vortices disposed within a perimeter of the at least one metering orifice such that atomization of the flow path is enhanced outward of the at least one metering orifice.

24. The method of claim 15, wherein the targeting of the fuel flow comprises configuring the first channel surface between an inner edge at approximately a first distance from the longitudinal axis and at approximately a first spacing along the longitudinal axis relative to the metering disc and an outer edge at approximately a second distance from the longitudinal axis and at approximately a second spacing from the metering disc along the longitudinal axis, such that a product of the first distance and first spacing is generally equal to a product of the second distance and second spacing.

25. The method of claim 15, wherein the targeting comprises targeting the fuel flow within an arcuate sector extending at least 50 millimeters along the longitudinal axis.

26. The method of claim 15, wherein the arcuate sector comprises an arcuate sector of approximately 180 degrees about the longitudinal axis.

* * * * *